US006257918B1

(12) United States Patent
Yamamoto

(10) Patent No.: US 6,257,918 B1
(45) Date of Patent: Jul. 10, 2001

(54) WIRE HARNESS CONNECTOR HAVING A CONTACT RETENTION PLATE

(75) Inventor: Masahiro Yamamoto, Yokohama (JP)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 09/568,258

(22) Filed: May 10, 2000

(30) Foreign Application Priority Data

Jan. 20, 2000 (JP) ..... 12-011697

(51) Int. Cl.[7] ..... H01R 13/627

(52) U.S. Cl. ..... 439/364; 439/34; 439/76.2; 439/378; 439/595

(58) Field of Search ..... 439/364, 76.2, 439/701, 374, 378, 34, 595

(56) References Cited

U.S. PATENT DOCUMENTS

| | | | |
|---|---|---|---|
| 2,822,529 | 2/1958 | Heath . | |
| 3,550,067 | 12/1970 | Hansen . | |
| 3,573,720 | 4/1971 | Reynolds . | |
| 4,557,543 | 12/1985 | McCleerey et al. . | |
| 4,721,478 | 1/1988 | Sonobe . | |
| 4,867,711 | 9/1989 | Yuasa . | |
| 5,118,306 | 6/1992 | Bixler et al. . | |
| 5,342,223 | 8/1994 | Geib . | |
| 5,403,221 | 4/1995 | Sayer et al. . | |
| 5,554,055 | 9/1996 | Miller . | |
| 5,820,401 * | 10/1998 | Hasz et al. | 439/364 |
| 5,836,787 * | 11/1998 | Kodama | 439/567 |
| 5,919,057 * | 7/1999 | Kameyama | 439/364 |
| 5,934,926 * | 10/1999 | Gabrisko, Jr. et al. | 439/364 |
| 5,993,255 * | 11/1999 | Yurko | 439/595 |

FOREIGN PATENT DOCUMENTS

| | | |
|---|---|---|
| 496765 | 1/1939 | (GB) . |
| 1097280 | 1/1968 | (GB) . |

* cited by examiner

*Primary Examiner*—Paula Bradley
*Assistant Examiner*—Truc Nguyen
(74) *Attorney, Agent, or Firm*—Hoffman & Baron, LLP

(57) ABSTRACT

A connector having a plug housing assembly supporting female contacts thereon, and a cap housing assembly supporting male contacts thereon. The plug housing assembly has a bolt rotatably passing therethrough and a locking plate for holding the male contacts. The cap housing assembly has a cavity receiving the plug housing assembly and a nut portion provided on a bottom portion of the cavity. A nut receiving recess, which receives the nut portion in the cap housing assembly when both the housing assemblies are fitted to each other, is provided in the plug housing assembly. A screw portion of the bolt is provided so as to be exposed within the nut receiving recess without protruding outward from the plug housing assembly. The locking plate has an actuator which is depressibly protruding from a circumferential surface of the plug housing assembly.

4 Claims, 11 Drawing Sheets

WIRE HARNESS CONNECTOR HAVING A CONTACT RETENTION PLATE

FIELD OF INVENTION

The present invention relates to a connector, for example, which is used for a wire harness of an automotive vehicle, and particularly to a connector in which the operability for a harnessing is improved.

BACKGROUND OF THE INVENTION

It has long been known to use connectors for wire harnesses of an automotive vehicle. Typically these connectors are of a type where a plug housing, supporting therein a female contact terminating the wire material and a cap housing, mounted on a printed circuit board and supporting a male contact, are fitted by fastening a bolt.

However, in this kind of conventional connector, a screw portion of a screwing bolt protrudes out of an outer portion of a plug housing. The protruding bolt frequently gets caught in the wire material, thereby significantly reducing the efficiency of the harnessing operation.

Further, in conventional products, there is provided means for locking the female contact terminating the wire material at two stages (an initial lock and a final lock). However, there is a disadvantage that when the bolt is fastened without operating this means, the bolt and the nut may serve the connector components as they are. Once the connector is fastened in this manner, the connection between the male and female contacts is poor.

An object of the present invention is to solve the disadvantage of the conventional water-proof contact mentioned above.

SUMMARY OF THE INVENTION

In order to achieve the object mentioned above, in accordance with the present invention, there is provided a connector comprising a plug housing assembly supporting a plurality of female contacts thereon, and a cap housing assembly fitted to the plug housing assembly and mounting a plurality of male contacts electrically connected to the female contacts respectively thereon, in which the plug housing assembly has a bolt rotatably passing through the plug housing assembly and a locking plate for holding the male contacts within the plug housing assembly, wherein the cap housing assembly has a cavity receiving the plug housing assembly and a nut portion provided on a bottom portion of the cavity and meshed with the bolt, wherein a nut receiving recess receiving the nut portion when both housing assemblies are fitted to each other is provided in the plug housing assembly, a screw portion of the bolt is exposed within the nut receiving recess without protruding outward from the plug housing assembly, and wherein the locking plate depressibly protrudes an actuator for operating the locking plate on a circumferential surface of the plug housing assembly.

DETAILED DESCRIPTION OF PREFERRED EMBODIMENT

Figure 1:
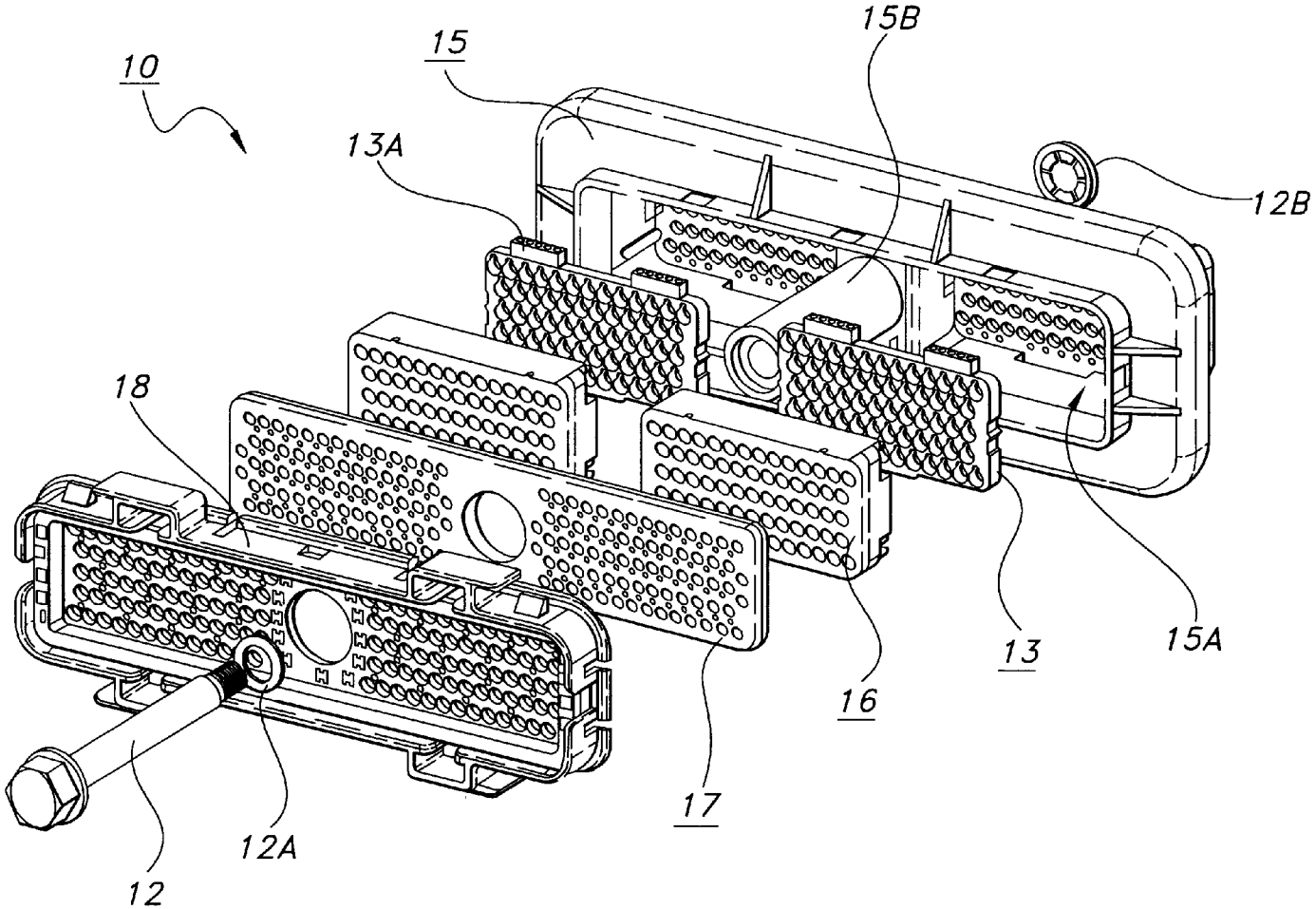
FIG. 1 is an exploded perspective view of a plug housing assembly for a connector in accordance with an embodiment of the present invention.

A connector in accordance with the present invention includes a plug housing connector assembly 10 and a cap housing assembly 20 fitted thereto. The connector assemblies are fitted and held by engaging a screwing bolt 12, provided in the plug housing assembly, with a nut portion 23 provided in the cap housing.

The plug housing assembly supports a plurality of female contacts 11 thereon, and the cap housing assembly supports a plurality of male contacts 21 which are electrically connected to the female contacts respectively thereon.

Figure 2:
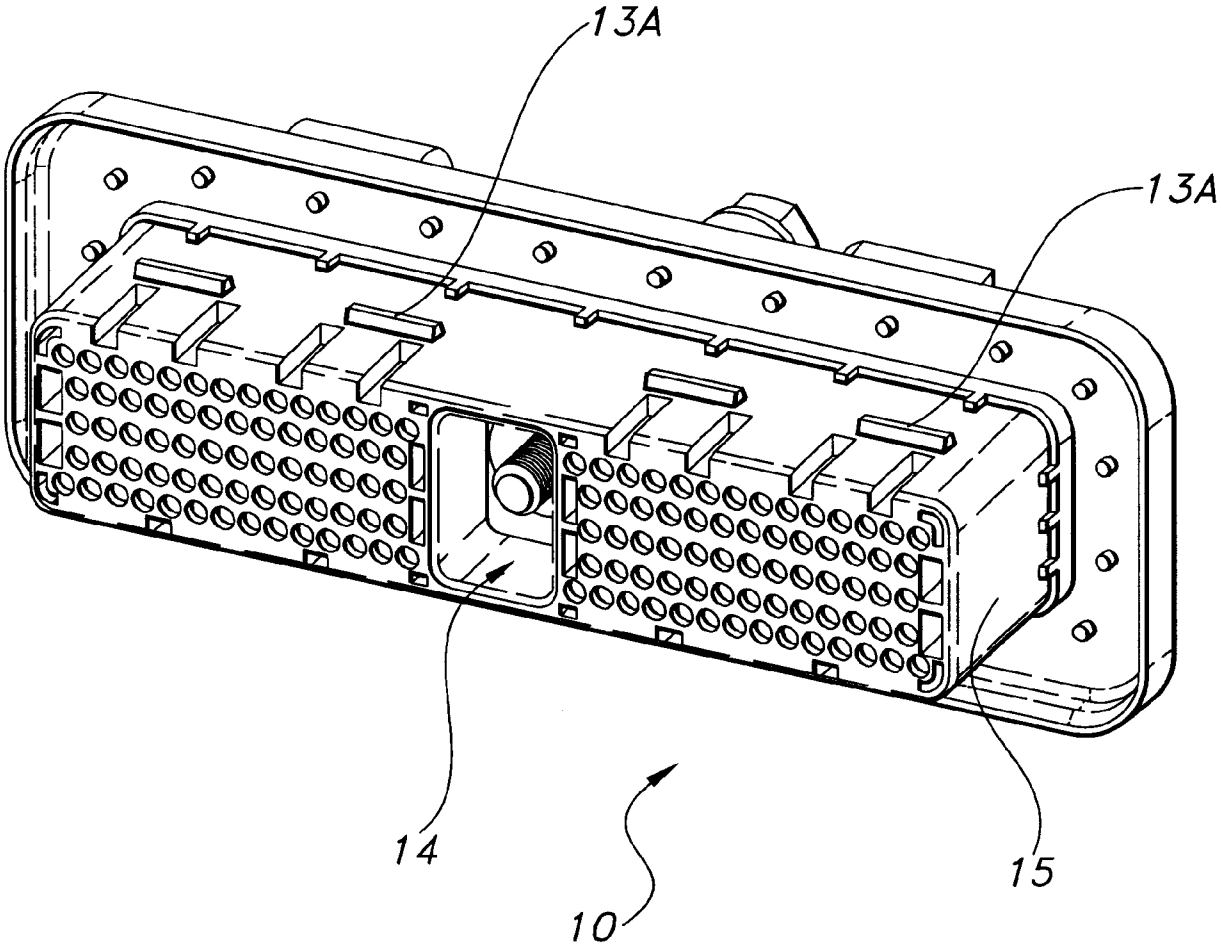
FIG. 2 is a perspective view of the plug housing assembly in an assembled state as seen from a front face side.
Figure 3:
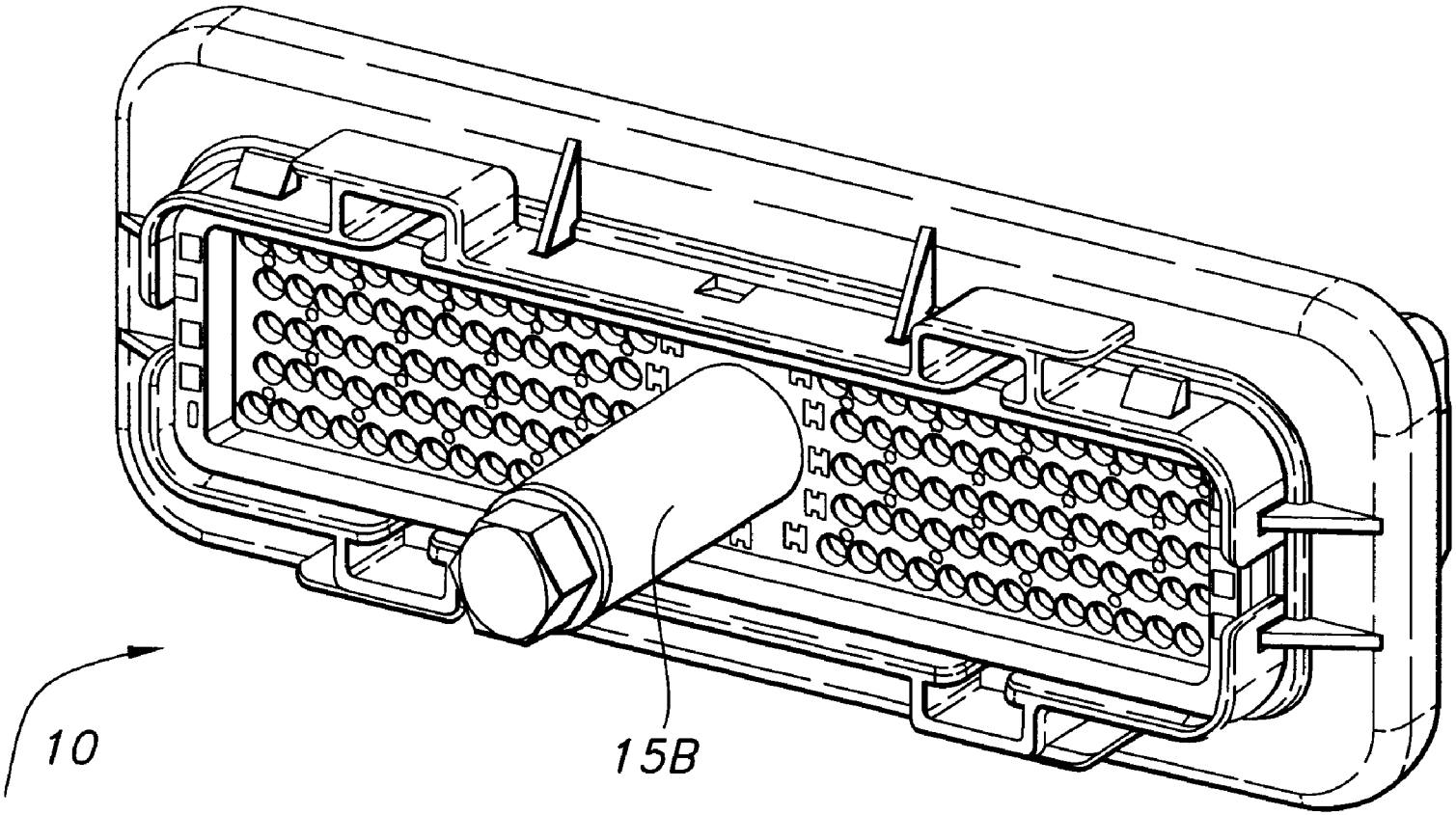
FIG. 3 is a perspective view of the plug housing assembly shown in FIG. 2 as seen from a back face side.

FIG. 1 is an exploded perspective view of the plug housing assembly of a connector (a water-proof type) in accordance with an embodiment of the present invention. FIG. 2 is a perspective view of the plug housing assembly in an assembled state as seen from a front face side. FIG. 3 is a perspective view of the same as seen from a back face side.

The plug housing assembly shown in FIG. 1 includes a plug housing body 15, a locking plate 13, a contact holding member 16, a rubber bushing 17 and a back plate 18 which are subsequently received in a recess portion 15A provided in the plug housing body, preferably in this order.

In the drawings, reference numeral 12 denotes a screwing bolt, reference numeral 12A denotes an O-ring which is fitted to the bolt, and reference numeral 12B denotes a stop ring which is fitted to a front end portion of the bolt. Further, reference numeral 15B denotes a cylindrical shaft supporting portion to which the bolt is inserted and which protrudes from the bottom surface of the recess portion 15A of the plug housing body through the locking plate 13, the contact holding member, the bushing and the back plate.

The bottom surface of the recess portion in the plug housing body, the locking plate, the contact holding member, the bushing and the back plate are respectively provided with through holes for inserting and holding a plurality of contacts (of a female type in the illustrated embodiment) so that positions of the through holes are aligned with each other between the elements.

The contact holding member is provided with, for example, a lance in the through hole, thereby being engaged with a constricted or narrow portion (refer to FIG. 4) of the contact inserted into the through hole so as to achieve an initial lock (an intermediate locking state).

The locking plate 13 is received within the recess portion 15A of the plug housing body so that it can move in a direction crossing the inserting direction of the contact. In the present embodiment, as shown in FIG. 2, a part (an actuator) 13A of the locking plate is depressibly protruded from a peripheral surface of the lug housing body.

When further pressing the contact, which is initially locked by the contact holding member, a front end (in the illustrated embodiment, a ferrule (refer to FIG. 4) receiving a pin contact mounted on the cap housing) of the contact passes through the locking plate and is held within the through hole of the housing main body. At this time, the constricted portion of the contact is positioned in the through hole (for example, an oval) of the locking plate. The constricted portion is engaged with the through hole of the locking plate by downward pressing of the actuator of the locking plate, thereby locking the contact so as not to come out from the plug housing assembly.

In FIG. 2, the plug housing assembly is provided with the nut receiving portion 14 which receives the nut provided in the cap housing assembly, in a front face side thereof. The screwing bolt passing through the shaft supporting portion is structured such that a screw portion thereof does not protrude outward from the plug housing body and is exposed within the nut receiving portion. In this case, the stop ring mentioned above is fitted to the bolt within a recess portion 14A having a depth deeper than that of the bottom portion of the nut receiving portion.

Figure 4A:
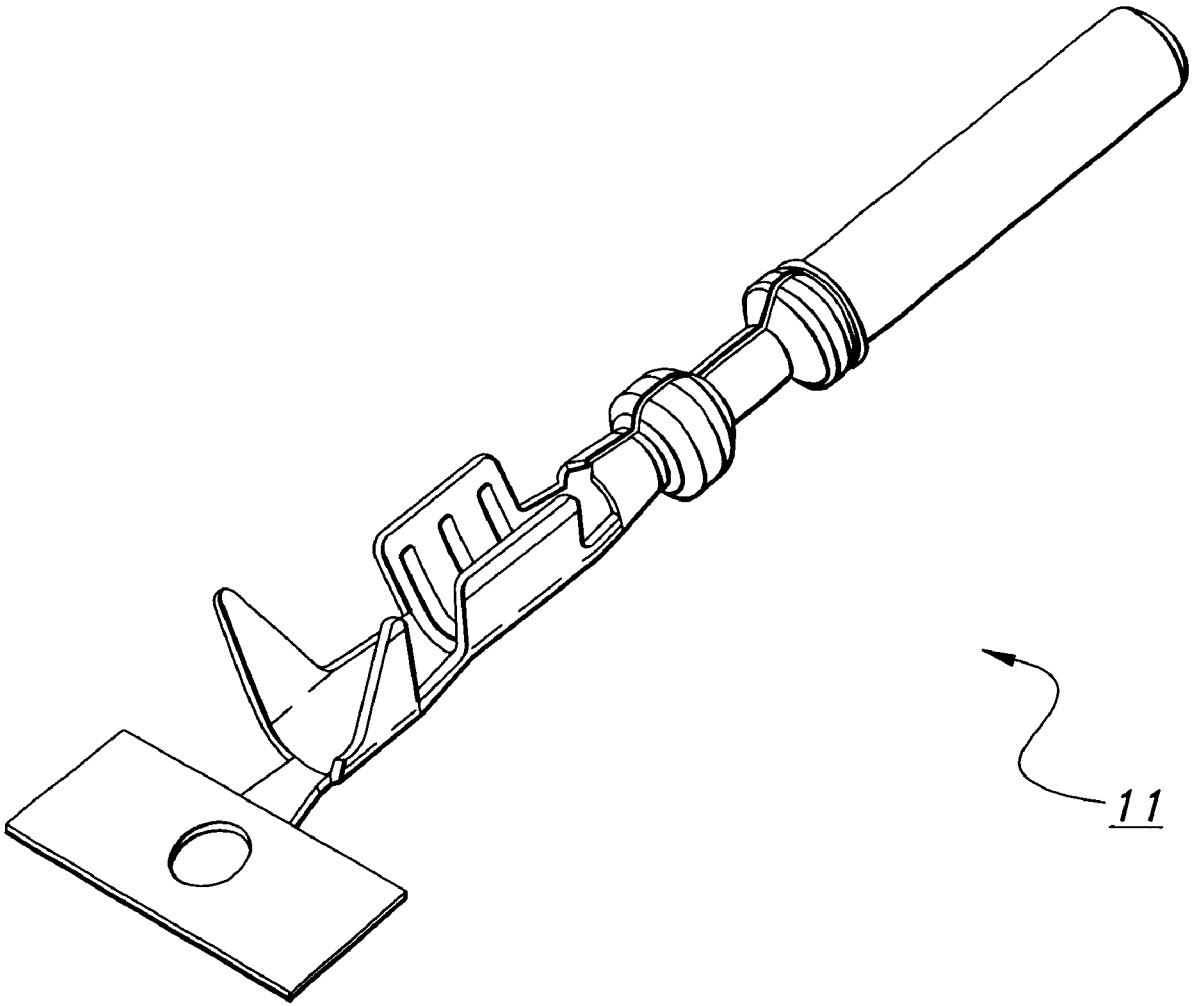
FIG. 4A is a perspective view which shows an embodiment of a female contact mounted on the plug housing assembly.
Figure 4B:
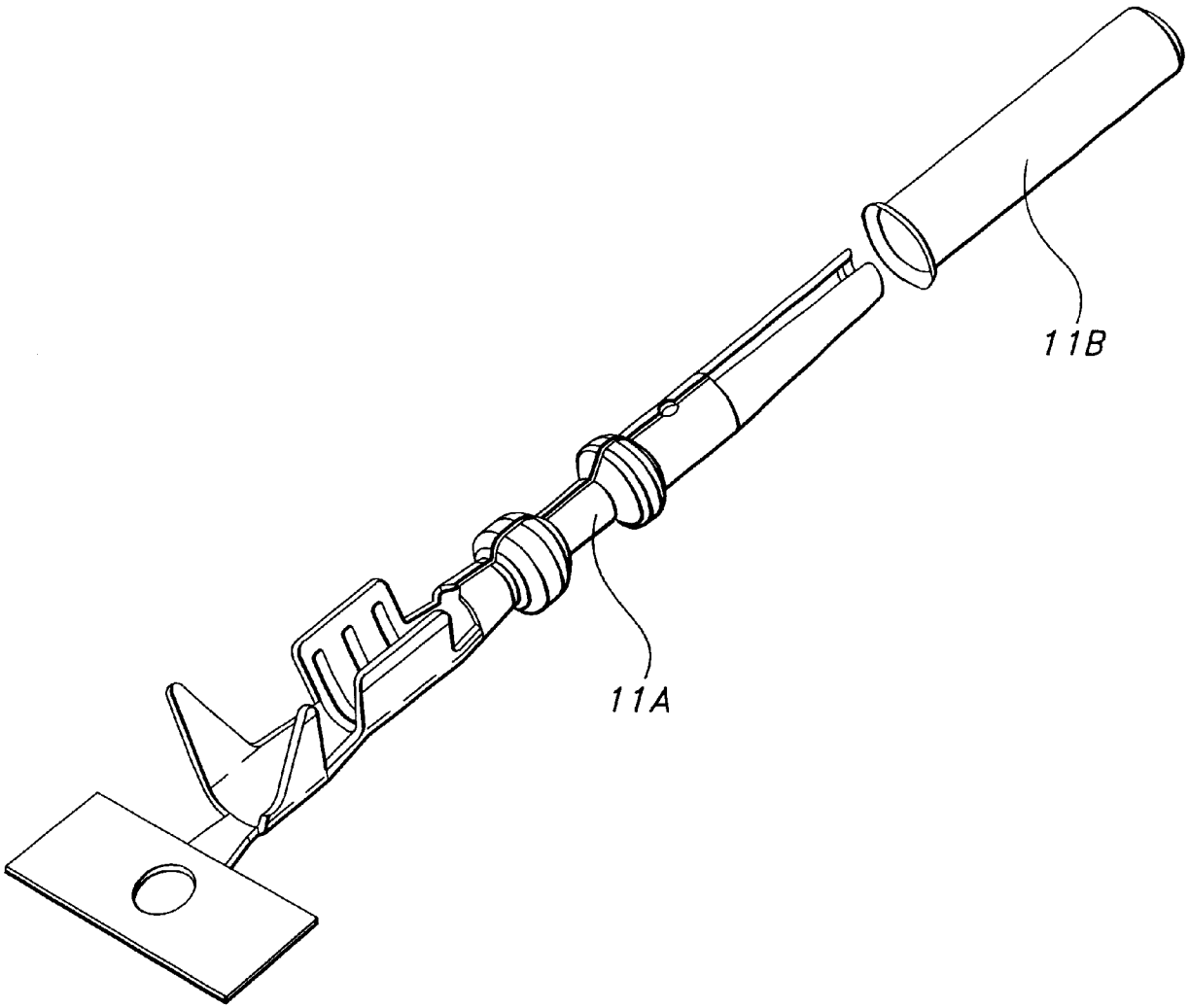
FIG. 4B is an exploded perspective view of the contact shown in FIG. 4A.

FIG. 4A shows an embodiment (receptacle contact) of the female contact 11 which is mounted on the plug housing assembly. A body portion 11A terminates a wire material and a ferrule 11B receives the pin contact mounted on the cap housing assembly. FIG. 4B is an exploded view thereof. A constricted or narrow portion which is engaged with the locking plate mentioned above is formed in a body portion of the contact.

Figure 5:
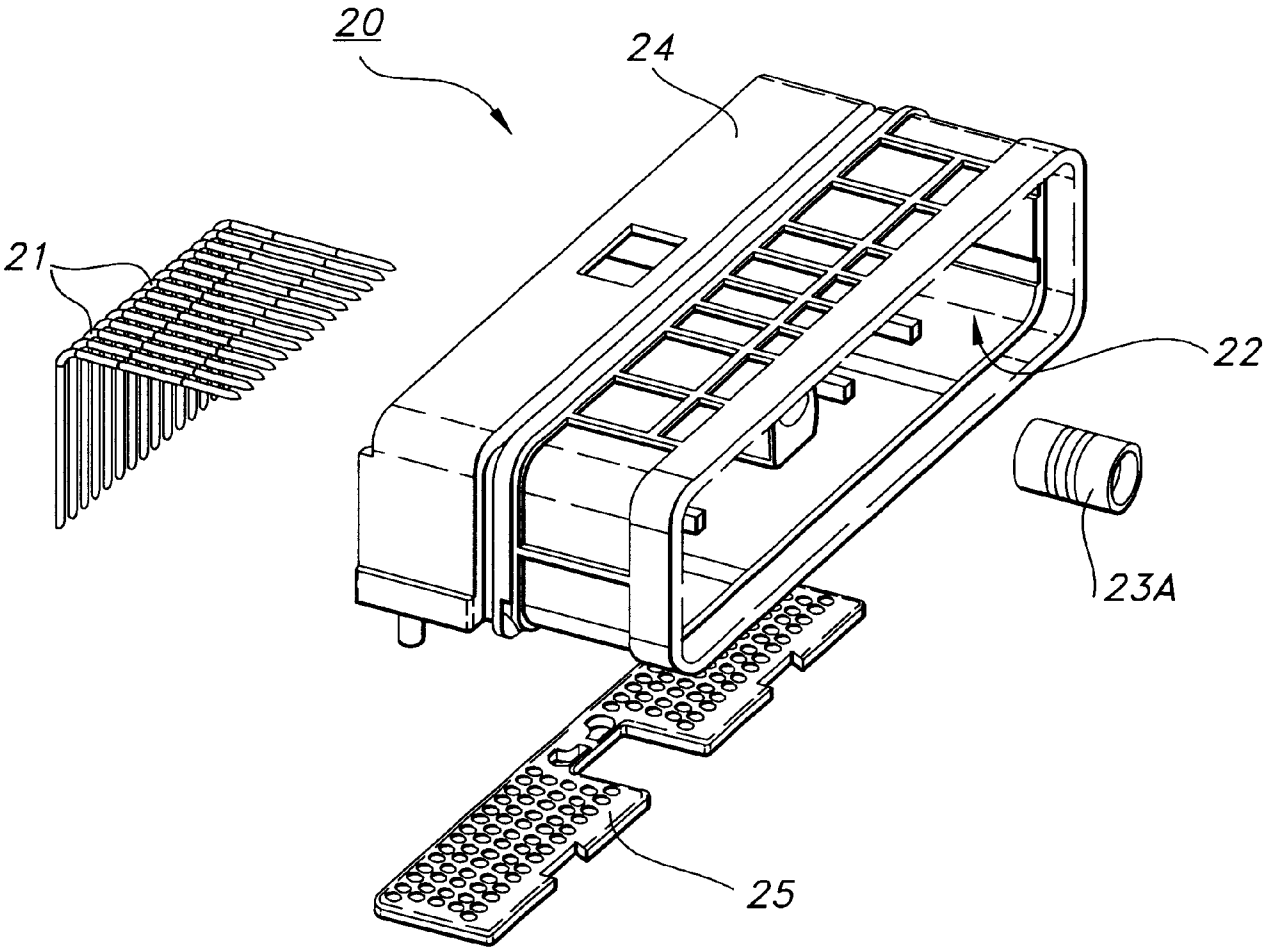
FIG. 5 is an exploded perspective view of a cap housing assembly of a connector in accordance with an embodiment of the present invention.

Next, a description will be given of the cap housing assembly. FIG. 5 is an exploded perspective view of the cap housing assembly of a connector (of a water-proof type) in accordance with an embodiment of the present invention, FIG. 6 is a perspective view of the plug housing assembly in an assembled state as seen from a front face side, and FIG. 7 is a perspective view of the same as seen from a back face side.

The cap housing assembly shown in FIG. 5 includes a cap housing main body 24, a cavity 22 which receives the plug housing assembly and a nut portion 23 which protrudes from the bottom of the cavity. In the present embodiment, the nut portion has a nut main body 23A which is meshed with the screwing bolt and inserted therein, and is received in the nut receiving portion of the plug housing at a time of fitting both the housing assemblies to each other. The nut main body is meshed with the screwing bolt.

Figure 6:
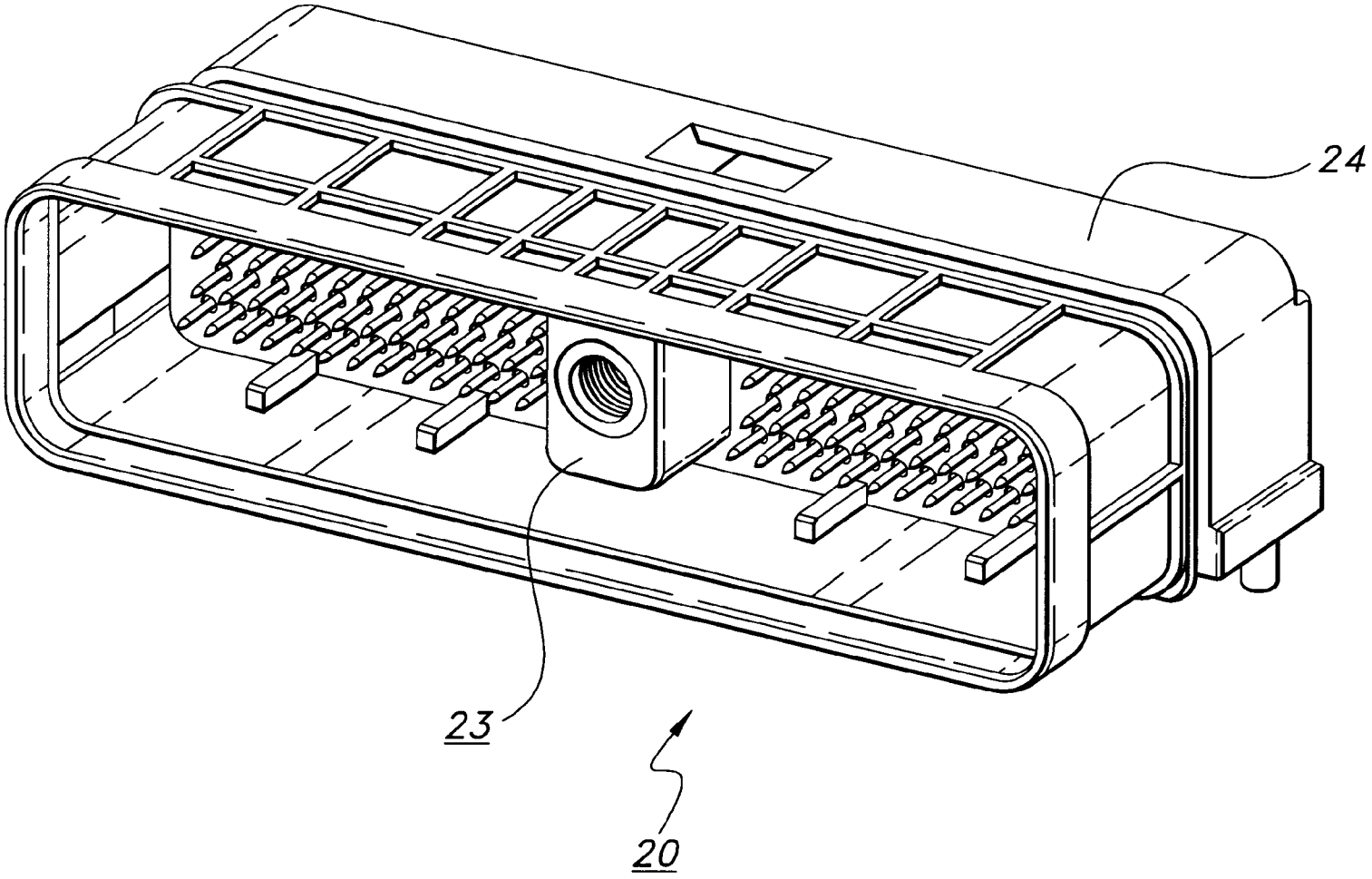
FIG. 6 is a perspective view of the cap housing assembly in an assembled state as seen from a front face side.
Figure 7:
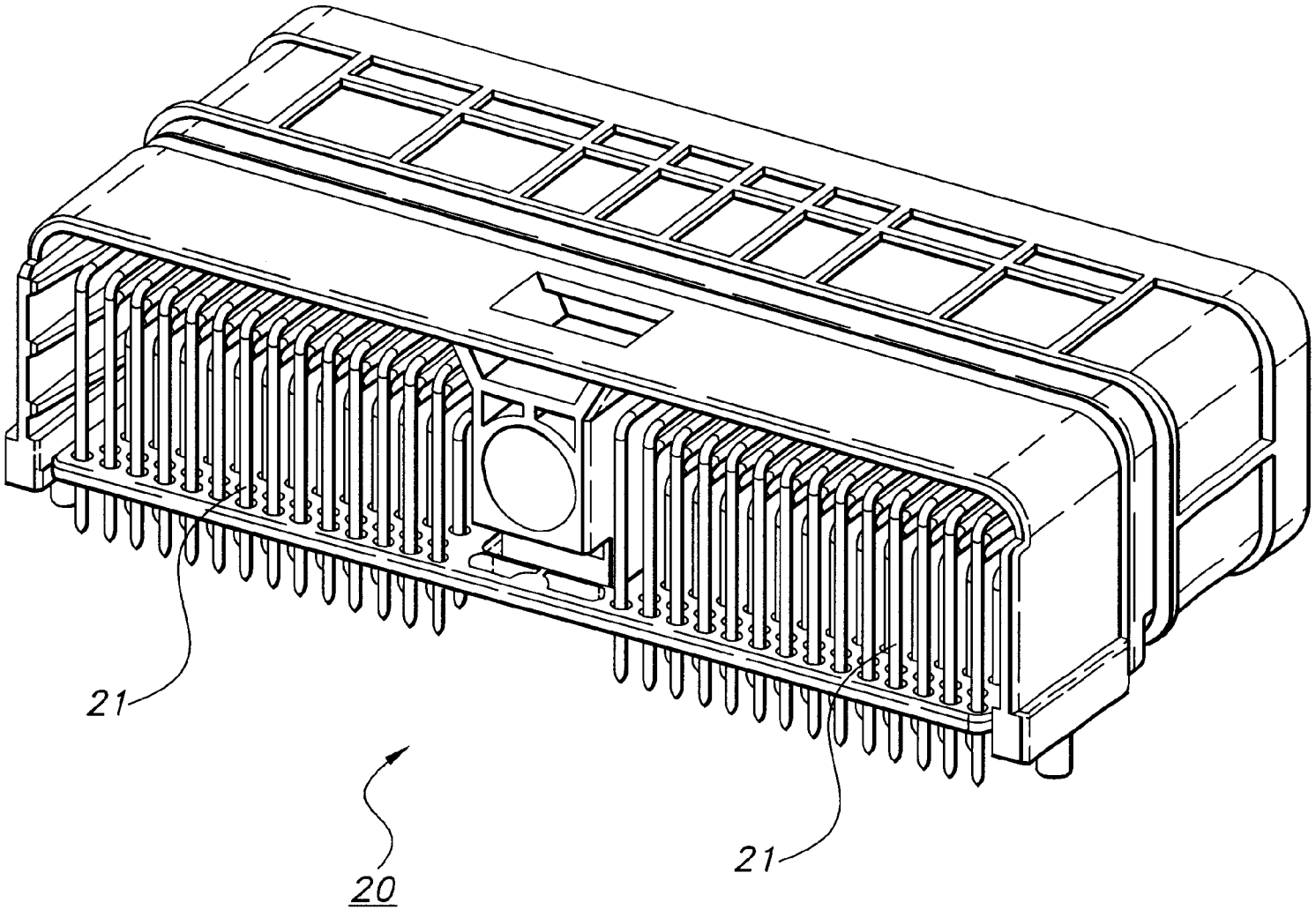
FIG. 7 is a perspective view of the cap housing assembly shown in FIG. 6 as seen from a back face side.

In the drawings, reference numeral 21 denotes an L-shaped male contact (a pin contact in the illustrated embodiment) which is mounted on the cap housing main body, in which one terminal is fixed, for example, to a printed circuit board (not shown) and another terminal is protruded within the cavity through the cap housing main body (refer to FIG. 6). Reference numeral 25 denotes an alignment plate which has a plurality of through holes provided in correspondence to the contacts mounted on the cap housing main body and is placed within the cavity so as to align the contact protruding within the cavity.

Figure 8:
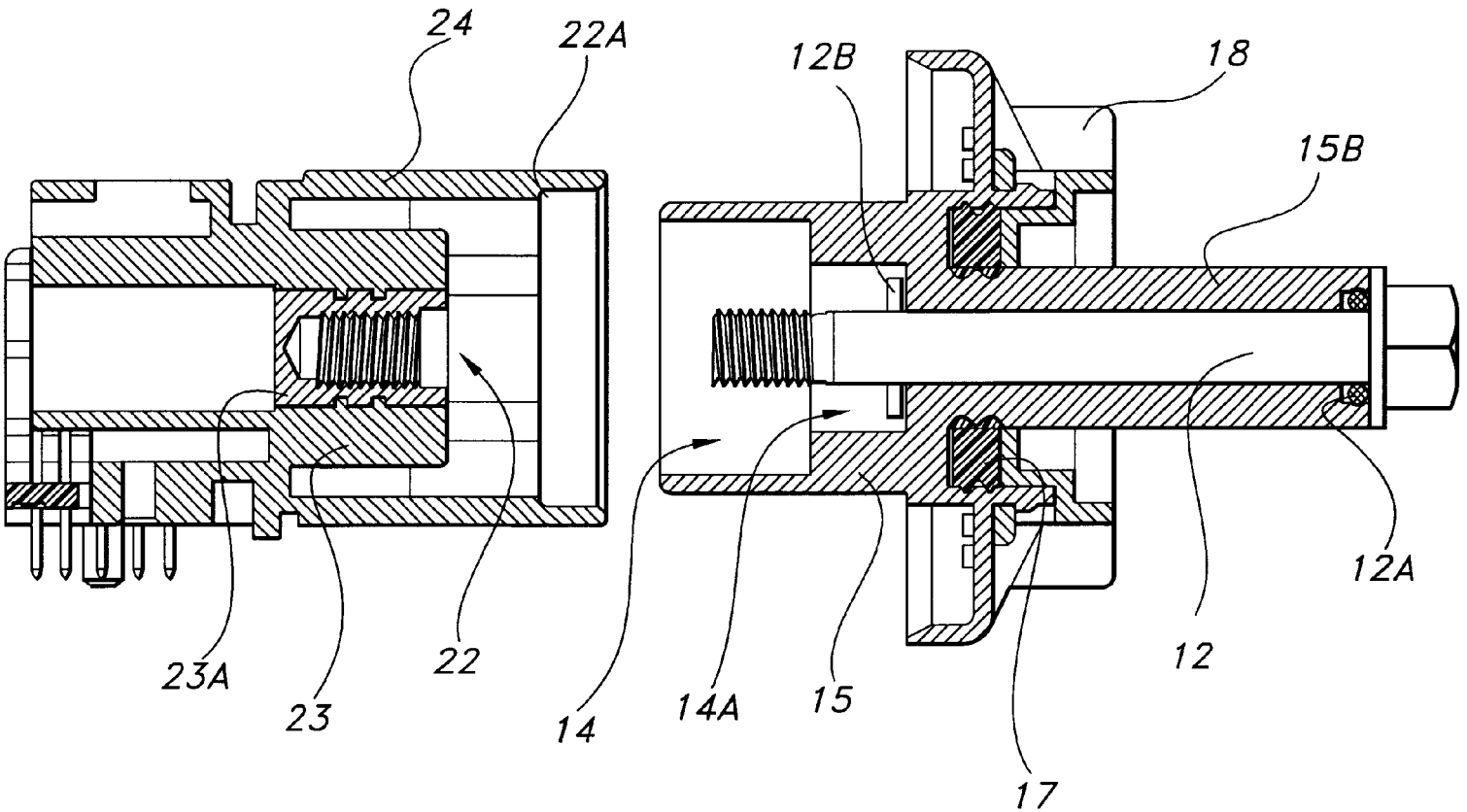
FIG. 8 is a cross sectional view which shows fitting the plug housing assembly and the cap housing assembly in accordance with the present invention by means of a screwing.
Figure 9:
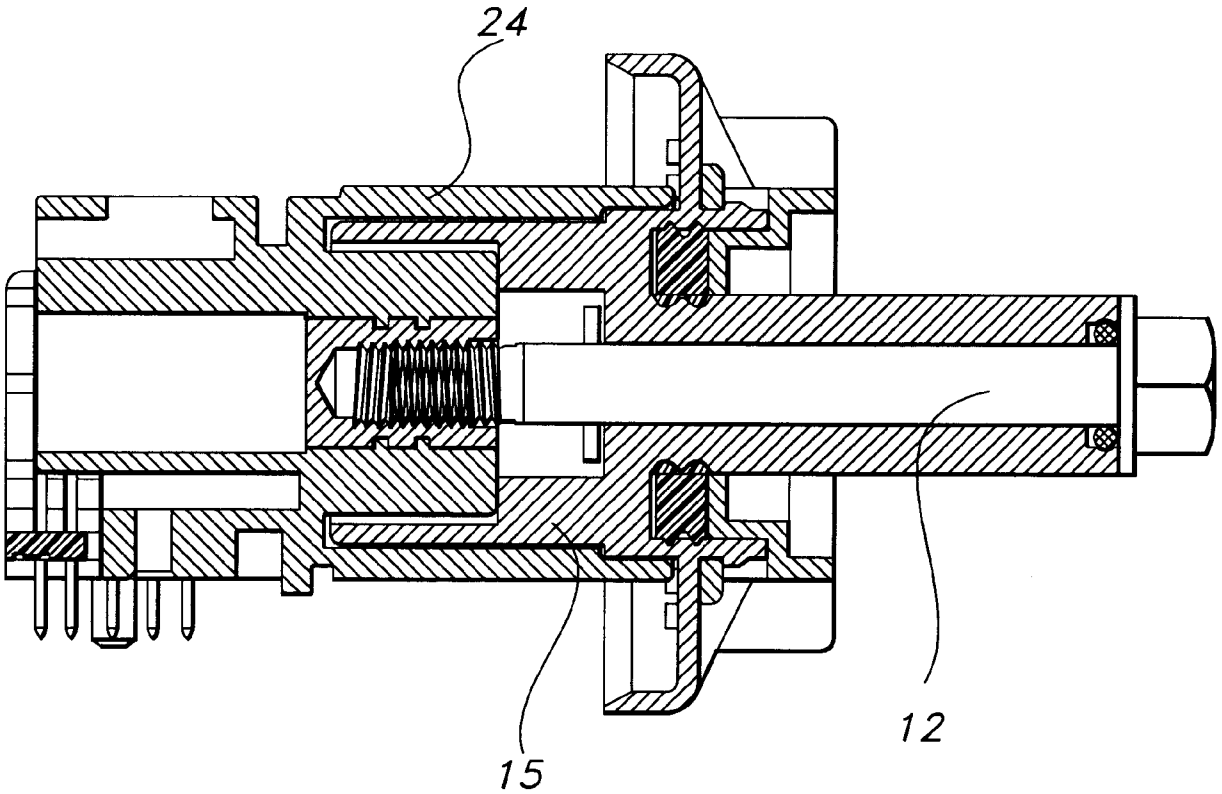
FIG. 9 is a cross sectional view which shows fitting the plug housing assembly and the cap housing assembly in accordance with the present invention by means of a screwing.
Figure 10:
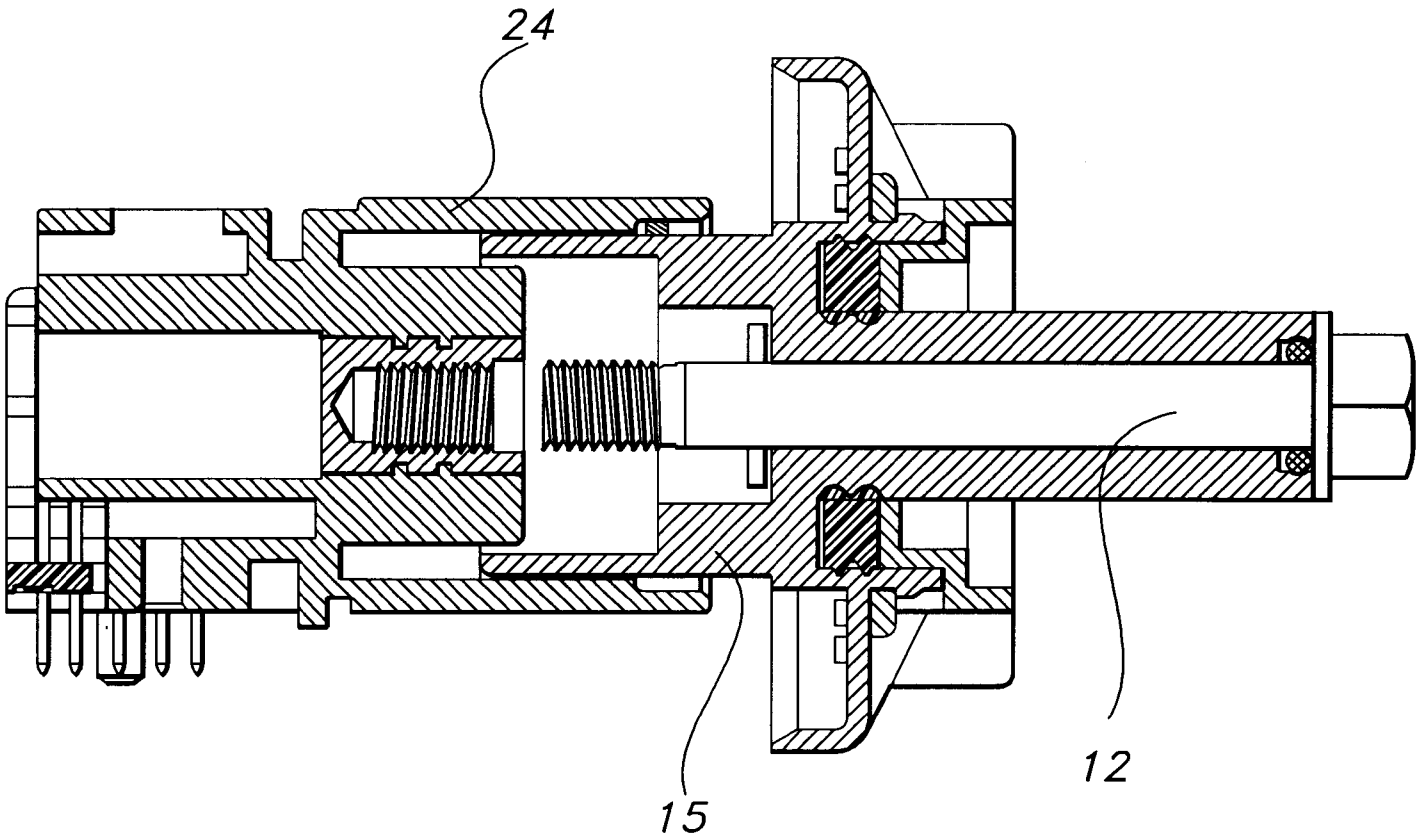
FIG. 10 is a cross sectional view which shows fitting the plug housing assembly and the cap housing assembly in accordance with the present invention by means of a screwing.

FIGS. 8 to 10 are cross sectional views which show the fitting of the plug housing assembly and the cap housing assembly in accordance with the present invention by means of a screwing. FIG. 8 shows a state in which both the housing assemblies are separated from each other. FIG. 9 shows a state in which the fitting between both the housing assemblies shown in FIG. 8 is completed. As illustrated, the screwing bolt of the plug housing assembly is meshed with the nut of the cap housing and both the housing assemblies are fitted.

FIG. 10 shows the plug housing assembly fitted to the cap housing assembly without operating the lock plate (performing the final lock) in the plug housing assembly. At this time, since the actuator of the locking plate protrudes (is not depressed) from the peripheral surface of the plug housing body, the fitting between the plug housing assembly and the cavity in the cap housing is prevented.

In this case, in the embodiment shown in FIG. 10, a step portion 22A is provided in an opening portion of the cavity in the cap housing so that the actuator of the locking plate protruding from the peripheral surface of the plug housing is brought into contact therewith.

The structure of the connector in accordance with the present invention is made as mentioned above, however, the following distinctive effects can be obtained by the structure.

At first, since the nut receiving portion, which receives the nut portion of the cap housing assembly which is fitted to the cap housing assembly, is provided in the plug housing assembly of the connector in accordance with the present invention, and the screw portion of the screwing bolt is provided so as to be exposed within the nut receiving portion without protruding outward from the plug housing assembly, the screwing bolt does not get caught in the wire material of the harness and it is possible to significantly improve an efficiency of the harnessing operation.

Further, since the actuator of the locking plate protrudes from the peripheral surface of the plug housing body even when it is intended to fit the plug housing assembly with the cap housing assembly without finally locking the contact in the plug housing assembly, it is impossible to insert the plug housing body into the cavity of the cap housing. The fitting between both the housing assemblies is prevented.

Accordingly, in the connector in accordance with the present invention, it is possible to prevent the disadvantage that the male and female housing assemblies are screwed with the poor contact mounting.

Various changes to the foregoing described and shown structures would now be evident to those skilled in the art. Accordingly, the particularly disclosed scope of the invention is set forth in the following claims.

What is claimed is:

1. A connector comprising:

a plug housing assembly 10 supporting therein a plurality of female contacts 11, and a cap housing assembly 20 to be connected to said plug housing assembly, said cap housing assembly supporting therein a plurality of male contacts 21 to be electrically connected to the female contacts of said plug housing assembly, respectively, wherein said plug housing assembly comprises a bolt 12 pivotably inserted therethrough and a locking late 13 for locking the female contacts therein, and said cap housing assembly comprises a cavity 22 for receiving said plug housing assembly and a nut portion 23 for mating the bolt, said nut portion being formed on a bottom of the cavity, wherein said plug housing assembly further comprises a nut receiving recess 14, said recess receiving the nut portion when said both housing assemblies are connected to each other, and a screw section of said bolt extends to the nut receiving recess without protruding externally from said plug housing assembly, and wherein said locking plate is arranged slidably along a direction crossing an insertion direction of the female contacts.

2. A connector according to claim 1, wherein said plug housing assembly further comprises a plug housing body 15, the locking plate 13, a contact holding member 16, and a bushing 17 and a back plate 18, wherein said locking plate, the contact holding member, the bushing and the back plate are accommodated in order in a recess 15A formed in the plug housing body, and wherein the plurality of female contacts are mounted in said plug housing via these members.

3. A connector according to claim 2, wherein said plug housing body includes an extending cylindrical shaft supporting portion 15B for accommodating said bolt.

4. A connector according to claim 3, wherein said cylindrical shaft supporting portion extends through said locking plate.

* * * * *